US006739991B1

(12) United States Patent
Wardropper

(10) Patent No.: US 6,739,991 B1
(45) Date of Patent: May 25, 2004

(54) METHOD AND APPARATUS FOR MAKING A CERAMIC ARROWHEAD BLADE

(76) Inventor: Byron G. Wardropper, 12150 Wilshire Dr., North Huntingdon, PA (US) 15642

( * ) Notice: Subject to any disclaimer, the term of this patent is extended or adjusted under 35 U.S.C. 154(b) by 0 days.

(21) Appl. No.: 10/174,265

(22) Filed: Jun. 18, 2002

(51) Int. Cl.[7] ..... F42B 6/08
(52) U.S. Cl. ..... 473/578; 473/583
(58) Field of Search ..... 473/578, 582, 473/583, 584

(56) References Cited

U.S. PATENT DOCUMENTS

| | | | | |
|---|---|---|---|---|
| 2,909,372 A | * | 10/1959 | Neri | |
| 3,618,948 A | | 11/1971 | McGlocklin | 273/106.5 B |
| 4,452,459 A | * | 6/1984 | Doonan | |
| 4,974,859 A | * | 12/1990 | Briesemeister | |
| 5,137,282 A | * | 8/1992 | Segar et al. | |
| 5,203,573 A | | 4/1993 | Brailean | 273/422 |
| 5,251,907 A | | 10/1993 | Ady | 273/416 |
| 5,390,936 A | * | 2/1995 | Westenburg | |
| 5,458,337 A | | 10/1995 | Jabben | 273/419 |
| 5,562,291 A | | 10/1996 | Garcia | 273/419 |
| 5,636,845 A | * | 6/1997 | Newnam | |
| 5,931,751 A | * | 8/1999 | Cooper | 473/583 |
| 6,151,786 A | | 11/2000 | Hellstern | 30/346.53 |
| 6,186,913 B1 | | 2/2001 | Thomas | 473/581 |
| 6,260,280 B1 | | 7/2001 | Rapisardi | 30/357 |
| 6,277,041 B1 | | 8/2001 | Fenn | 473/578 |
| 6,595,881 B1 | * | 7/2003 | Grace et al. | 473/583 |
| 2002/0151393 A1 | * | 10/2002 | Liechty | 473/578 |

FOREIGN PATENT DOCUMENTS

GB 2 219 218 A 6/1989

* cited by examiner

*Primary Examiner*—John A. Ricci
(74) *Attorney, Agent, or Firm*—Webb Ziesenhiem Logsdon Orkin & Hanson, P.C.

(57) ABSTRACT

A ceramic arrowhead blade comprising a body with two linear edges directed toward each other, wherein the ceramic arrowhead blade includes at least one sharp linear edge, the body having a base between the two linear edges. The ceramic arrowhead blade can be made of any ceramic material, such as zirconia, tungsten carbide or alumina. In addition, the ceramic arrowhead blade can have a textured or dimpled surface and serrations along the linear edges. The ceramic arrowhead blade can be received by a shank which is attached to an arrow body to form an arrow. The ceramic arrowhead blade can be made by selecting a ceramic material and then molding the ceramic material into an arrowhead, wherein the arrowhead can molded with at least one sharp linear edge.

36 Claims, 2 Drawing Sheets

METHOD AND APPARATUS FOR MAKING A CERAMIC ARROWHEAD BLADE

BACKGROUND OF THE INVENTION

1. Field of the Invention

The present invention relates to an apparatus and method for making an arrowhead blade, particularly a ceramic arrowhead blade.

2. Description of Related Art

Arrows and arrowheads have been utilized throughout history and are still commonly used today, primarily for hunting. Due to the increase in popularity of the sport of hunting, arrows are continuously designed to be faster, stronger to achieve full penetration of an object, and lighter. Most commonly used arrowheads are made of steel. However, steel arrowheads are heavy, and weight is a critical factor in the performance of the arrowhead. The weight of an arrowhead is critical because it determines the dynamics of arrow flight and also affects the speed of the arrowhead. In addition to the weight of steel arrowheads, the blade edges of the steel arrowheads are also subject to corrosion. The lack of wear resistance of these edges also decreases the life of the arrowhead. Thus, while the steel arrowheads may be stronger, they have a greater propensity for blade corrosion and wear resistance of the sharp edges. To avoid the occurrence of corrosion and the heaviness of the steel arrowheads, lighter materials can be used to make the arrowheads, such as plastic. However, these lighter arrowheads are ineffective because they lack in strength to complete full penetration of an object Therefore, it is an object of the present invention to provide an apparatus and method for making a stronger, lighter arrowhead which has better wear and corrosion resistance.

SUMMARY OF THE INVENTION

The present invention is directed to a ceramic arrowhead blade. The ceramic arrowhead blade includes a body with two linear edges directed toward each other. At least one of the linear edges is sharp. The body has a base between the two linear edges. The two linear edges can be directed toward each other to form a vertex. The two linear edges can also have serrations along the length of the edges or periodically along the edges. The ceramic arrowhead blade can be made of any ceramic material, such as zirconia, tungsten carbide or alumina. The body of the ceramic arrowhead blade may have a textured surface, such as dimples. Preferably, the ceramic arrowhead blade can have a weight of up to approximately 200 grains. The ceramic arrowhead blade may have two sharp linear edges.

The present invention is also directed to an arrow. The arrow includes a ceramic arrowhead blade, a body, a shank and an arrow body. The body of the ceramic arrowhead blade has two linear sharp edges directed toward each other as well as a base between the two edges. At least one of the linear edges is sharp. The two linear edges can be directed toward each other to form a vertex. The two linear edges can also have serrations along the length of the edges or periodically along the edges. The ceramic arrowhead blade can also have two sharp linear edges. The shank is attached to the ceramic arrowhead blade. The arrow body is attached to the shank to form the arrow. The ceramic arrowhead blade can be made of ceramic material, such as zirconia, tungsten carbide or alumina and can preferably have a weight of up to approximately 200 grains. The ceramic arrowhead blade may also have a body with a textured surface, such as dimples. The shank may receive a plurality of ceramic arrow blades.

The present invention is further directed to a ceramic arrowhead. The ceramic arrowhead includes a ceramic arrowhead blade and a shank. The ceramic arrowhead blade includes a body with two linear edges directed toward each other and a base between the two linear edges. At least one of the linear edges is sharp. The two linear edges can be directed toward each other to form a vertex. The two linear edges can also have serrations along the length of the edges or periodically along the edges. The body can also have a textured surface. The shank is attached to the ceramic arrowhead blade. The ceramic arrowhead may include a unitary ceramic arrowhead blade with two sharp linear edges. The ceramic arrowhead may include a plurality of ceramic arrowhead blades, where each of the ceramic arrowhead blades have one sharp linear edge.

The present invention is also directed to a powder metal arrowhead blade. The powder metal arrowhead blade includes a body with two linear edges directed toward each other and a base between the two linear edges. At least one of the linear edges is sharp.

The present invention is further directed to a polymeric arrowhead blade. The polymeric arrowhead blade includes a body with two linear edges directed toward each other and a base between the two linear edges. At least one of the linear edges is sharp.

The present invention is also directed toward a method for making a ceramic blade. The method includes providing a ceramic material and molding the ceramic material into an arrowhead. The arrowhead may be molded with at least one sharp linear edge.

DESCRIPTION OF THE PREFERRED EMBODIMENTS

Figures 1, 2, 2A, 3, 3A, 4, 4A:
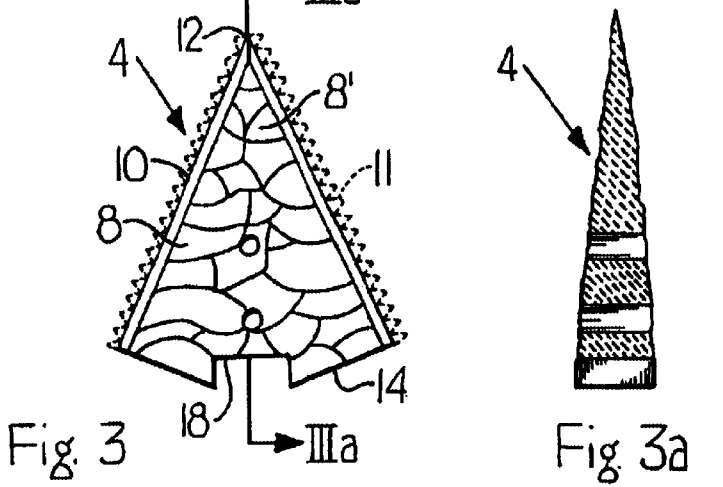
FIG. 1 is a top plan view of an arrow in accordance with one embodiment of the present invention.
FIG. 2 is a top plan view of a ceramic arrowhead blade in accordance with one embodiment of the present invention.
FIG. 2*a* is a cross-sectional view taken along line IIa of FIG. 2 of the ceramic arrowhead blade.
FIG. 3 is a top plan view of a ceramic arrowhead blade with a textured surface in accordance with another embodiment of the present invention.
FIG. 3*a* is a cross-sectional view taken along line IIIa of FIG. 3 of the ceramic arrowhead blade with the textured surface.
FIG. 4 is a top plan view of a ceramic arrowhead blade with a recessed dimpled surface in accordance with a further embodiment of the present invention.
FIG. 4*a* is a cross-sectional view taken along line IVa of FIG. 4 of the ceramic arrowhead blade with the recessed dimpled surface.

FIG. 1 illustrates one embodiment of the present invention. An arrow 2 includes a ceramic arrowhead blade 4 on a shank 6. The shank 6 is attached to an arrow body 7. The ceramic arrowhead blade 4 includes a body 8 with two linear edges 10 directed toward each other forming a vertex or tip 12. The two linear edges 10 are sharp. The body 8 has a base 14 between the two edges 10 opposite the vertex 12.

The shank 6 receives the ceramic arrowhead blade 4 and is attached to an arrow body 7 to form the arrow 2. The shank 6 can include a surface appearance similar to that of the ceramic arrowhead blade 4. The shank 6 preferably is anodized so that the shank 6 gives the appearance of being the same color as the ceramic arrowhead blade 4, thus allowing the ceramic arrowhead blade 4 and shank 6 to appear as one unitary piece.

FIGS. 2–5 illustrate preferred embodiments of the ceramic arrowhead blade 4. The ceramic arrowhead blade 4 can be made of any ceramic material, such as tungsten carbide or alumina, preferably, zirconia. The use of ceramic materials allows for greater wear and corrosion resistance than the use of steel arrowheads. This in turn eliminates the deterioration of the ceramic arrowhead blade 4 and therefore allows the ceramic arrowhead blade 4 to last longer and withstand greater force. The ceramic arrowhead blade 4 can also have a textured surface appearance. Preferably, the ceramic arrowhead blade 4 has a weight of up to approximately 200 grains, although it could be more.

Again as shown in FIGS. 2–5, the body 8 of each of the ceramic arrowhead blades 4 includes two sharp linear edges 10, directed toward each other forming a vertex 12. The two sharp linear edges 10 are knife-like edges and can be sharpened by hand, thus allowing for numerous reuses and the elimination for sharpening machinery. Alternatively, the linear edges 10 of the ceramic arrowhead blade 4 can be formed during the sintering process. Alternatively, the sharp linear edges 10 can be formed after sintering of the ceramic arrowhead blade 4 by sharpening machines used to sharpen ceramics. The ceramic arrowhead blade 4 can be resharpened by a sharpening machine adapted to sharpen ceramic blades. The body 8 can be of any shape, however, the conventional shape for an arrowhead is triangular. In addition, the two linear edges 10 can be directed toward each other to form any shape, such as a vertex 12. A gap area 18, located in the middle portion of base 6, allows the body 8 to be received on the shank 6 to form the arrow 2. FIG. 2*a* illustrates a cross-sectional view taken along line IIa of the ceramic arrowhead blade 4.

Figure 5A:
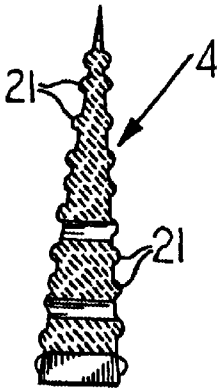
FIG. 5*a* is a cross-sectional view taken along line Va of FIG. 5 of the ceramic arrowhead blade with the protruding dimpled surface.
Figure 5:
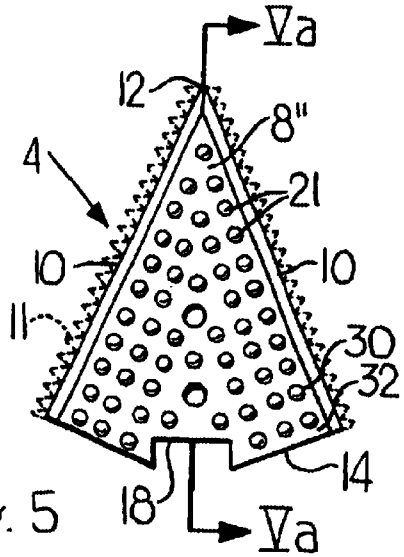
FIG. 5 is a top plan view of a ceramic arrowhead blade with a protruding dimpled surface in accordance with a further embodiment of the present invention.

FIGS. 3–5 depict further embodiments of the present invention that include many components which are substantially identical to the components of FIG. 2 except that a suffix ' and " will be used to identify those similar components in FIG. 2.

FIGS. 3–5 illustrate other embodiments of the present invention in which the body 8 can also have various surface configurations or appearances. FIG. 2 illustrates a body 8 with a smooth surface. FIG. 3 illustrates a body 8' of ceramic arrowhead blade 4 with a textured surface. The body 8' includes irregular peaks and valleys to create the textured surface. FIG. 3*a* is a cross-sectional view taken along line IIIa of ceramic arrowhead blade 4 with the textured surface. Additionally, the body 8' can have serrations 11, shown in phantom, along the linear edges 10. The serrations 11 aid in achieving deep penetration of an object. The serrations 11 can be along the length of the two linear edges 10 as illustrated in FIG. 3. The serrations II can also be located periodically along the length of the two linear edges 10 as shown in FIG. 4.

FIG. 4 illustrates a body 8" of ceramic arrowhead blade 4 with recessed dimples 20 formed in the body 8". The body 8" has an inner surface area 30 and an outer surface area 32. The inner surface area 30 is the surface area within the recessed dimples 20. The outer surface area 32 is the area surrounding the recessed dimples 20 and is the area making contact with an object during penetration. FIG. 4*a* is a cross-sectional view taken along line IVa of ceramic arrowhead blade 4 with a surface of recessed dimples 20. The recessed dimples 20 on the body 8" can be of any shape, preferably of a circular shape or teardrop shape. The surface area of the body 8" which is the inner surface area 30 of the recessed dimples 20 subtracted from the outer surface area 32, is reduced, thus decreasing the weight of the ceramic arrowhead blade 4. Therefore, the recessed dimples 20 act to reduce the surface area and weight, as well as friction of the body 8". By doing so, the ceramic arrowhead blade 4 can be faster and can obtain a cleaner and deeper penetration into a surface of an object.

Additionally, as illustrated in FIG. 5, the body 8" of ceramic arrowhead blade 4 can have protruding dimples 21. The protruding dimples 21 function in a similar manner to that of recessed dimples 20, except that they are elevated with respect to the surface of body 8" and it is the elevated areas that makes contact with the object during penetration. FIG. 5*a* is a cross-sectional view taken along line Va of the ceramic arrowhead blade 4 with a surface of protruding dimples 21. In other embodiments, a plurality of holes defined by the body 8 can be provided in lieu of the recessed dimples 20 where the holes pass through the body 8. Additionally, the ceramic arrowhead blade 4 can take on an appearance similar to that of the early Native American arrowheads which were hand hewn.

Figure 6:
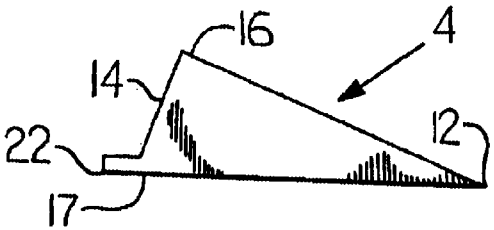
FIG. 6 is side plan view of a ceramic arrowhead blade in accordance with another embodiment of the present invention.

FIG. 6 illustrates a further embodiment of the ceramic arrowhead blade 4. FIG. 6 illustrates a side plan view of a ceramic arrowhead blade 4. The ceramic arrowhead blade 4 has two linear edges and a protruding member 22. The ceramic arrowhead blade 4 has one sharp linear edge 16 that is directed to the other linear edge 17 to form a vertex 12. The body 8 has a base 14 between sharp linear edge 16 and linear edge 17. The protruding member 22 is rectangular in shape, adjacent to linear edge 17 and extends from the base 14. The protruding member 22 is received by the shank 6.

Figure 7:
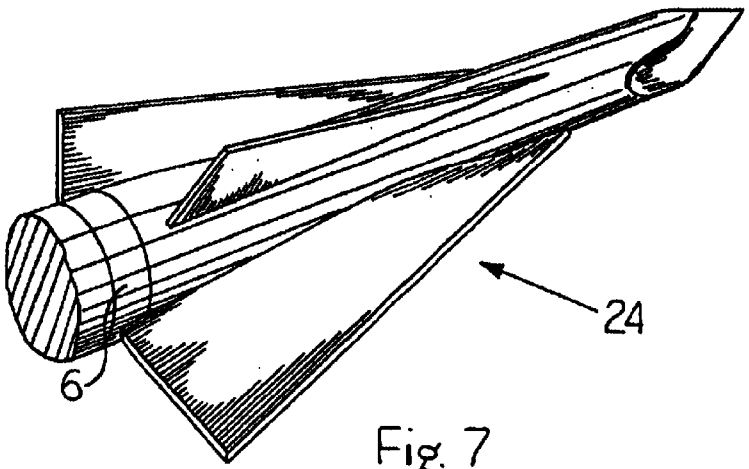
FIG. 7 is a perspective view of a ceramic arrowhead in accordance with another embodiment of the present invention.

While a ceramic arrowhead can be a unitary ceramic arrowhead blade 4 with two sharp linear edges as described above, another embodiment is illustrated in FIG. 7. A ceramic arrowhead 24 can also be arranged with a plurality of ceramic arrowhead blades 4. Preferably, four ceramic arrowhead blades 4 are provided spaced apart 90° around the shank 6 to create a ceramic arrowhead 24 (only three blades are shown). The shank 6 is used to hold the ceramic arrowhead blades 4. The ceramic arrowhead blade 4 can be of any ceramic material and has similar characteristics to the body 8, as described herein above. The ceramic arrowhead 24 preferably includes four ceramic arrowhead blades 4, however the ceramic arrowhead blades 4 can be placed in various desired arrangements.

The present invention is also directed to a powder metal arrowhead blade. The powder metal arrowhead blade includes a body with two linear edges directed toward each other and a base between the two linear edges. The powder metal arrowhead blade can be made of any powder metal such as aluminum or copper.

The present invention is further directed to a polymeric arrowhead blade. The polymeric arrowhead blade includes a body with two linear edges directed toward each other and a base between the two linear edges. At least one of the linear edges is sharp. The polymeric arrowhead blade can be made of any polymeric material, such as plastic and the like.

The ceramic arrowhead blade 4 can be formed by first providing a ceramic material. The ceramic material is then molded into a desired shape of the arrowhead. The ceramic arrowhead blade 4 can be molded with at least one sharp edge. Molding the ceramic material allows for the flexibility of sharpening knife edges or blade edges by hand, thereby eliminating the need for other equipment.

While a specific embodiment of the invention has been described in detail, it will be appreciated by those skilled in the art that various modifications and alternatives to those details could be developed in light of the overall teachings of the disclosure. The presently preferred embodiment described herein is meant to be illustrative only and not limiting as to the scope of the invention which is to be given the full breadth of the appended claims and any an all equivalents thereof.

What is claimed is:

1. A ceramic arrowhead blade, comprising a body with two linear edges directed toward each other, wherein the ceramic arrowhead blade includes at least one sharp linear edge, the body having a base between the two linear edges.

2. The ceramic arrowhead blade according to claim 1, wherein the two linear edges are sharp.

3. The ceramic arrowhead blade according to claim 2, wherein the two linear edges are directed toward each other forming a vertex.

4. The ceramic arrowhead blade according to claim 2, wherein the two linear edges are serrated.

5. The ceramic arrowhead blade according to claim 2, wherein the ceramic arrowhead blade is chosen from the group consisting of zirconia, tungsten carbide, and alumina.

6. The ceramic arrowhead blade according to claim 2, wherein the body has a textured surface.

7. The ceramic arrowhead blade according to claim 2, wherein the body has a dimpled surface.

8. The ceramic arrowhead blade according to claim 2, wherein the ceramic arrowhead blade has a maximum weight of 200 grains.

9. The ceramic arrowhead blade according to claim 1, wherein the two linear edges are directed toward each other forming a vertex.

10. The ceramic arrowhead blade according to claim 1, wherein the two linear edges are serrated.

11. The ceramic arrowhead blade according to claim 1, wherein the ceramic arrowhead blade is chosen from the group consisting of zirconia, tungsten carbide, and alumina.

12. The ceramic arrowhead blade according to claim 1, wherein the body has a textured surface.

13. The ceramic arrowhead blade according to claim 1, wherein the body has a dimpled surface.

14. The ceramic arrowhead blade according to claim 1, wherein the ceramic arrowhead blade has a maximum weight of 200 grains.

15. An arrow, comprising:

a ceramic arrowhead blade, comprising a body with two linear edges directed toward each other, wherein the ceramic arrowhead blade includes at least one sharp linear edge, the body having a base between the two linear edges;

a shank attached to the ceramic arrowhead blade; and an arrow body attached to the shank to form the arrow.

16. The arrow according to claim 15, wherein the two linear edges are sharp.

17. The arrow according to claim 16, wherein the two linear edges are directed toward each other forming a vertex.

18. The arrow according to claim 16, wherein the two linear edges are serrated.

19. The arrow according to claim 16, wherein the ceramic arrowhead blade is chosen from the group consisting of zirconia, tungsten carbide, and alumina.

20. The arrow according to claim 16, wherein the ceramic arrowhead blade has a body with a textured surface.

21. The arrow according to claim 16, wherein the ceramic arrowhead blade has a body with a dimpled surface.

22. The arrow according to claim 16, wherein the ceramic arrowhead blade has a maximum weight of 200 grains.

23. The arrow according to claim 16, wherein the shank receives a plurality of blades.

24. The arrow according to claim 15, wherein the two linear edges are directed toward each other forming a vertex.

25. The arrow according to claim 15, wherein the two linear edges are serrated.

26. The arrow according to claim 15, wherein the ceramic arrowhead blade is chosen from the group consisting of zirconia, tungsten carbide, and alumina.

27. The arrow according to claim 15, wherein the ceramic arrowhead blade has a body with a textured surface.

28. The arrow according to claim 15, wherein the ceramic arrowhead blade has a body with a dimpled surface.

29. The arrow according to claim 15, wherein the ceramic arrowhead blade has a maximum weight of 200 grains.

30. The arrow according to claim 15, wherein the shank receives a plurality of ceramic arrowhead blades.

31. A ceramic arrowhead, comprising:

a ceramic arrowhead blade, comprising a body with two linear edges directed toward each other, wherein the ceramic arrowhead blade includes at least one sharp linear edge, the body having a base between the two linear edges; and a shank attached to the ceramic arrowhead blade.

32. The ceramic arrowhead according to claim 31, wherein the two linear edges are directed toward each other forming a vertex.

33. The ceramic arrowhead according to claim 31, wherein the two linear edges are serrated.

34. The ceramic arrowhead according to claim 31, wherein the ceramic arrowhead includes a unitary ceramic arrowhead blade with two sharp linear edges.

35. The ceramic arrowhead according to claim 31, wherein the ceramic arrowhead includes a plurality of ceramic arrowhead blades, each of the ceramic arrowhead blades having one sharp linear edge.

36. The ceramic arrowhead according to claim 31, wherein the body has a textured surface.

* * * * *